United States Patent [19]

Uchida

[11] 4,116,347

[45] Sep. 26, 1978

[54] QUICK COUPLER

[75] Inventor: Tomio Uchida, Sapporo, Japan

[73] Assignee: Caterpillar Mitsubishi Ltd., Tokyo, Japan

[21] Appl. No.: 764,139

[22] Filed: Jan. 31, 1977

[30] Foreign Application Priority Data

Feb. 3, 1976 [JP] Japan ..... 51-009960

[51] Int. Cl.[2] ..... E02F 3/81

[52] U.S. Cl. ..... 214/145 A; 172/272

[58] Field of Search ..... 214/145 A, 131 A; 172/272, 273, 274

[56] References Cited

U.S. PATENT DOCUMENTS

| | | | |
|---|---|---|---|
| 3,818,551 | 6/1974 | Coughran, Jr. | 214/145 A |
| 3,935,953 | 2/1976 | Stedman | 214/145 A |
| 4,013,182 | 3/1977 | Pratt et al. | 214/145 A |

FOREIGN PATENT DOCUMENTS

| | | | |
|---|---|---|---|
| 106,518 | 6/1965 | Norway | 214/145 A |

*Primary Examiner*—Albert J. Makay
*Assistant Examiner*—Ross Weaver
*Attorney, Agent, or Firm*—Charles E. Lanchantin, Jr.

[57] ABSTRACT

A quick coupler for attaching and detaching an implement to a vehicle equipped with a lift arm and a tilt link includes a hitch having a lower supporting assembly pivotally connected to the lift arm, an upper supporting assembly pivotally connected to the tilt link, and an actuator pivotally connected between the supporting assemblies and movable between an extended position and a retracted position, the lower and upper supporting assemblies being positioned between a substantially aligned first condition and an angularly collapsed second condition at the extended and retracted positions of the actuator, and a hook arrangement having a lower hook portion and an upper hook portion secured to the implement and respectively receiving the lower and upper supporting assemblies.

10 Claims, 6 Drawing Figures

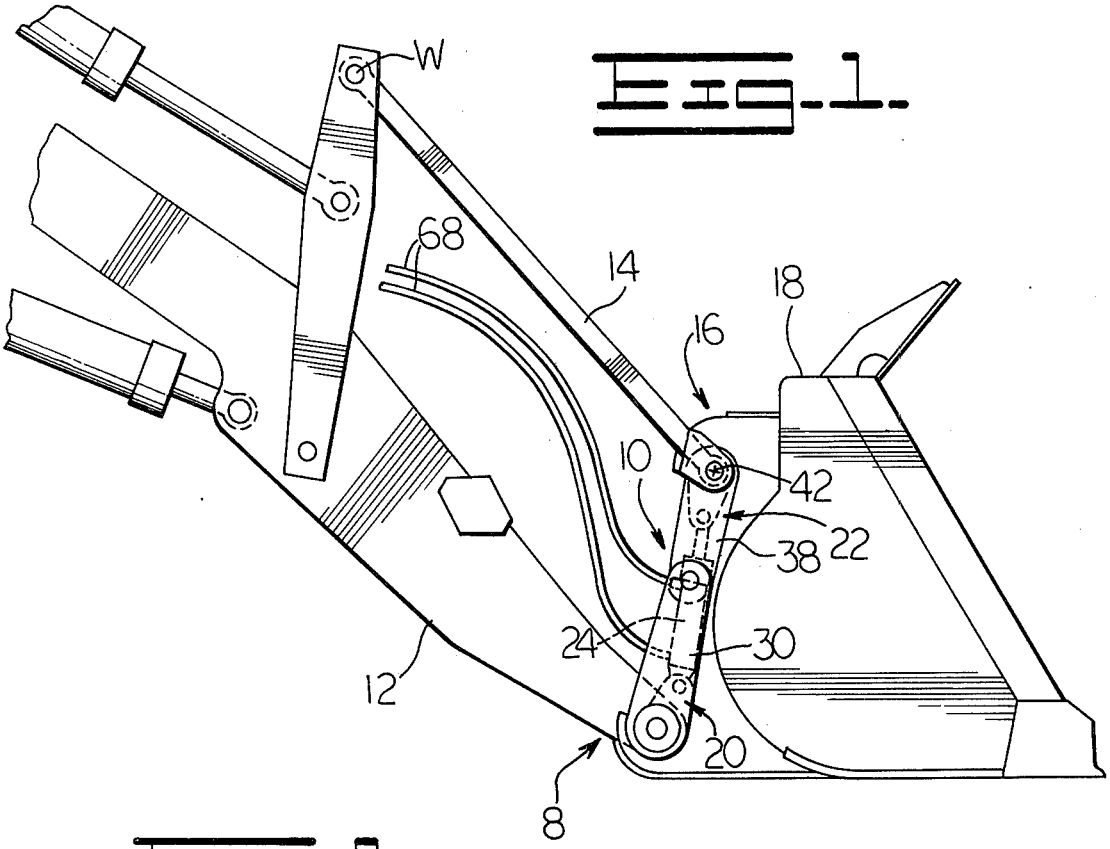
Fig. 1
Fig. 2
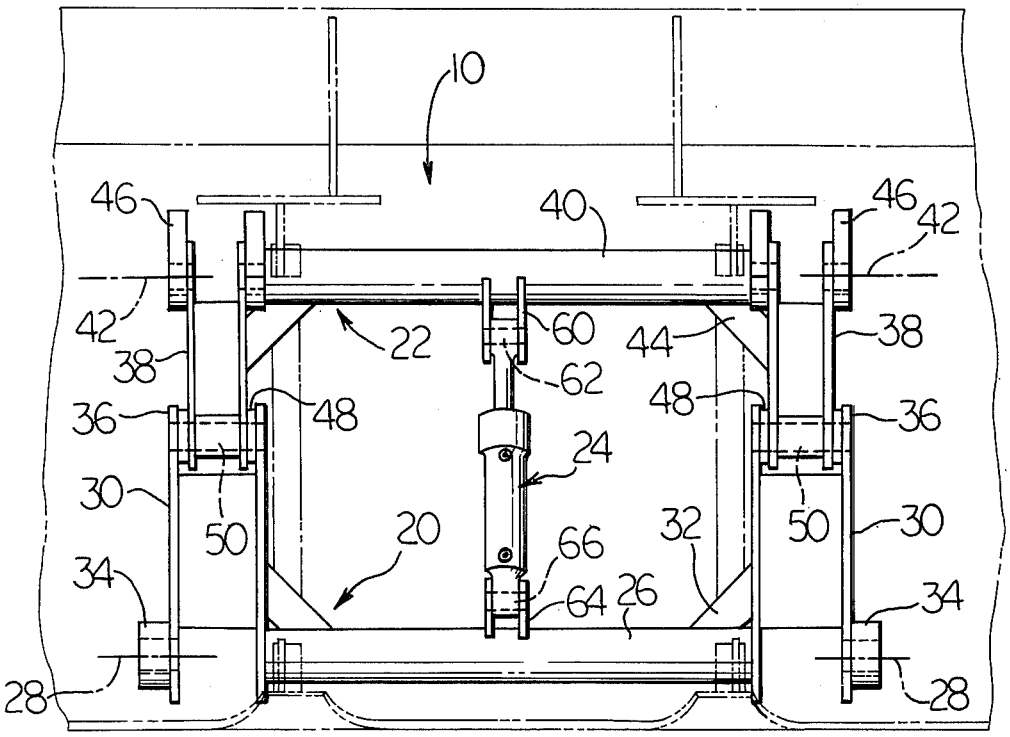

QUICK COUPLER

BACKGROUND OF THE INVENTION

This invention relates to a quick coupler, and more particularly to a quick coupler for attaching an implement to, and detaching an implement from a vehicle equipped with a lift arm and a tilt link.

An earthmoving vehicle equipped with a lift arm and a tilt link, such as a wheel loader, may accomplish a multitude of operations by attaching various working implements thereto. For instance, a loader equipped with a bucket can load and transport earth or the like, while a loader equipped with a fork can load and transport material on pallets or pipes. In this manner a single earthmoving vehicle may be used for multiple purposes, if such implements may be conveniently attached to the vehicle as required.

Quick disconnect and attachment mechanisms for securing various implements to a vehicle are exemplified by U.S. Pat. Nos. 3,243,066, issued Mar. 29, 1966 to C. W. Gardner, et al; 3,417,886, issued Dec. 24, 1968 to C. F. Stuart; 3,760,883, issued Sept. 25, 1973 to B. D. Birk; 3,818,551, issued June 25, 1974 to S. J. Coughran, Jr.; and 3,935,953, issued Feb. 3, 1976 to R. N. Stedman.

However, the known prior art mechanisms, including those designated immediately above, are unsatisfactory from several standpoints. For example, the relatively complex mechanism of U.S. Pat. No. 3,760,883 is subject to misalignment problems so that the powerably moved pins on the hitch have difficulty extending into the openings provided therefor on the implement. Moreover, such pins are exposed to dirt and tend to wear unevenly, causing undesirable looseness in the coupling. Other known mechanisms are excessibly large or are of a construction which subjects the hydraulic jack thereof to impart loads during operation of the implement. Still further, some mechanisms are subject to possible disengagement problems as a result of inadvertent leakage of the fluid communicating with the hydraulic jack, and which jack provides for quickly disconnecting the hitch portion carried by the vehicle from the hook portion secured to the various implements.

SUMMARY OF THE INVENTION

The present invention is directed to overcoming one or more of the problems as set forth above.

According to the present invention, there is provided a quick coupler for attaching and detaching an implement to a vehicle equipped with a lift arm and a tilt link, which coupler includes a hitch having a lower supporting assembly pivotally connected to the lift arm, an upper supporting assembly pivotally connected to the tilt link, and an actuator which is pivotally connected between the supporting assemblies and movable between an extended position and a retracted position, the lower and upper supporting assemblies being positioned between first and second conditions at the extended and retracted positions of the actuator, and a hook arrangement having a lower hook portion and an upper hook portion secured to the implement and respectively receiving the lower and upper supporting assemblies.

BRIEF DESCRIPTION OF THE DRAWINGS

FIG. 1 is a side elevational view of a quick coupler constructed in accordance with the present invention.

FIG. 2 is a rear elevational view of the hitch portion of the quick coupler illustrated in FIG. 1, and showing a portion of the implement in phantom.

DESCRIPTION OF THE PREFERRED EMBODIMENT

Figure 3:
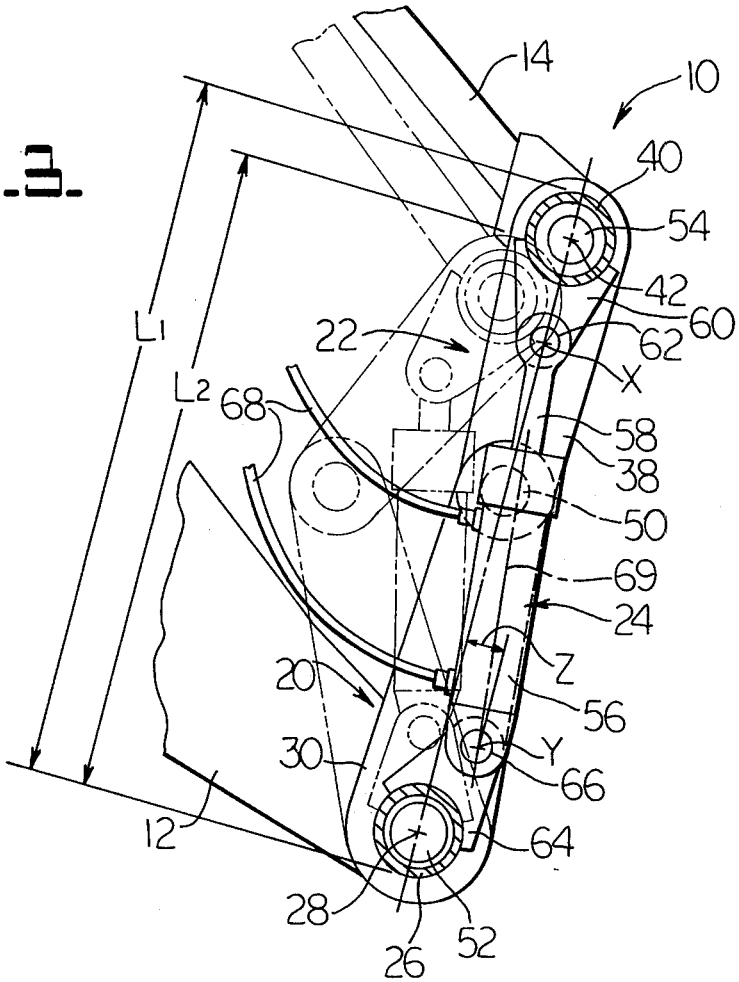
FIG. 3 is a cross sectional view of the hitch shown in FIG. 2 diagrammatically illustrating the aligned and collapsed conditions thereof.

Referring to FIG. 1, a quick coupler 8 constructed in accordance with the present invention includes a hitch 10 coupled to the forwardly extending tip portions of a pair of lower supports or lift arms 12 (one shown) and the tip portion of a pair of upper supports or tilt links 14 (one shown) mounted on a conventional earthmoving vehicle such as a wheel loader or the like, and a hook arrangement 16 secured to the back surface of an implement 18, such as a bucket, to be coupled to the vehicle.

Referring now to FIGS. 2 and 3, the hitch 10 has a lower supporting assembly 20 and an upper supporting assembly 22, as well as a hydraulic actuator or jack 24 of selectively variable length whose one end is pivotally connected to the lower supporting assembly and whose other end is pivotally connected to the upper supporting assembly.

The lower supporting assembly 20 includes a lower connecting member or cylindrical pipe 26 having an axis 28 which extends transversely in a horizontal plane. A pair of lower link members 30 are welded to the lower connecting member and extend upwardly therefrom at a right angle to the axis. The rigid connection therebetween may be reinforced by gussets or plates 32. Each of the lower link members has a bearing portion 34 at its lower end which is adapted to rotatably carry the tip portion of one of the lift arms 12, and another bearing portion 36 adapted to rotatably carry the free end of one of a pair of upper link members 38 of the upper supporting assembly 22.

The upper supporting assembly 22 includes an upper connecting member or cylindrical pipe 40 having an axis 42 which also extends transversely in a horizontal plane. The upper link members 38 are welded to the upper connecting member at the opposite ends thereof, and extend downwardly therefrom at a right angle to the axis 42. The connection therebetween may also be reinforced by gussets or plates 44. Each of the upper link members is provided with a bearing portion 46 at its upper end which rotatably carries a tip portion of one of the tilt links 14, and another bearing portion 48 which rotatably carries the free or upper end of one of the lower link members 30.

The free ends of the lower link members 30 of the lower supporting assembly 20 are each pivotally coupled to the free ends of the upper link members 38 of the upper supporting assembly 22 by a pin 50 adapted to be inserted into the bearing portions 36 and 48.

As best shown in FIG. 3, the lower supporting assembly 20 is pivotally coupled to the forwardly disposed tip portions of the lift arms 12 by a pair of pins 52 which are inserted into the bearing portions 34. The upper supporting assembly 22 is pivotally coupled to the forwardly disposed portions of the tilt links 14 by a pair of pins 54 which are inserted into the bearing portions 46.

The actuator or hydraulic jack 24 is of conventional double acting construction having a cylinder or head end portion 56 and a piston or rod end portion 58 fitted therein. The rod end portion is pivotally connected to a bracket 60 which is centrally secured to the upper connecting member 40 by a pin 62, while the head end portion is pivotally connected to a bracket 64 centrally secured to the lower connecting member 26 by a pin 66. Pressure fluid is supplied to the jack through either of a pair of conduits or lines 68 communicating with a control valve system, not shown, and a source of hydraulic fluid under pressure in the usual manner.

Accordingly, the hitch 10 may be hydraulically positioned between a substantially aligned first condition, wherein the lower link member 30 is aligned with the upper link member 38 as shown in solid lines in FIG. 3, to an angularly collapsed second condition wherein the lower link member is disposed at an obtuse angle to the upper link member as shown in phantom. In the first condition, a distance $L_1$ is defined between the under surface of the lower connecting member 26 and the top surface of the upper connecting member 40, whereas in the second condition a lesser distance $L_2$ is defined between the same points due to retraction of the jack 24. In the instant example, the center X of the pin 62 is positioned on a centerline between the axes 28 and 42 and through the center of the pin 50 in the first condition. Moreover, the central axis 69 of the jack is positioned forwardly, or to the right when viewing the drawing, of the pin 50. Specifically, the center Y of the pin 66 is offset a preselected distance Z forwardly or to the right of the aforementioned centerline. With such construction, retraction of the jack will move the pin 50 rearwardly or to the left about the lower axis 28, while, as shown in FIG. 1, the upper axis 42 follows an arcuate locus about a joint W of the tilt link 14 toward the lift arm 12 to thus provide the second condition. On the other hand, the hitch may be shifted back to the first condition by extension of the jack.

Figure 4:
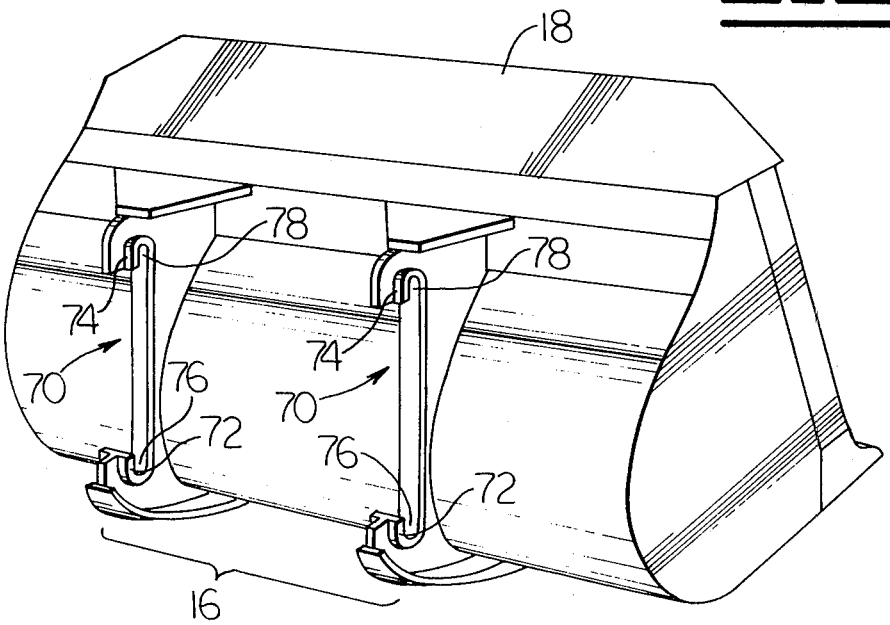
FIG. 4 is a perspective view of the hook portion of the quick coupler shown in FIG. 1.
Figure 5:
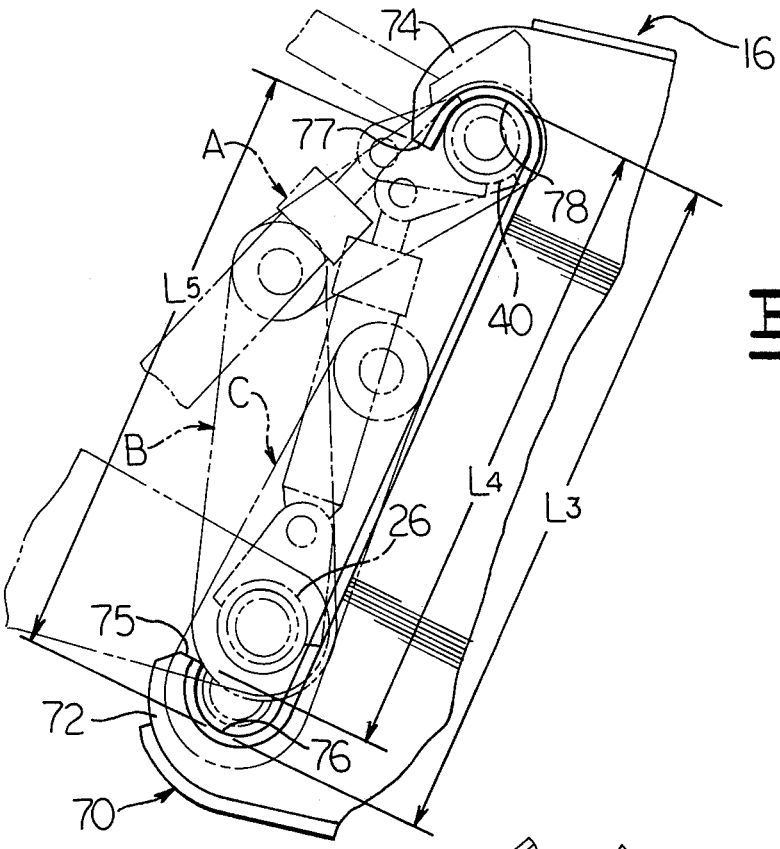
FIG. 5 is a cross sectional view diagrammatically illustrative of the coupling operation between the hitch and hook portions of the quick coupler shown in FIGS. 1–4.

Referring next to FIGS. 4 and 5, the hook arrangement 16 includes a pair of hook members 70 secured to the back surface of the bucket or implement 18. Each hook member has a lower hook portion 72 and an upper hook portion 74. Each of the lower hook portions opens upwardly so as to receive the lower connecting member 26 of the hitch 10, and has a lip 75 and a groove 76 of a semi-circular cross section which is complementary to the cross sectional shape of the lower connecting member. Each of the upper hook portions opens downwardly so as to receive the upper connecting member 40 of the hitch, and has a lip 77 and a groove 78 of a semi-circular cross section which is complementary to the cross sectional shape of the upper connecting member.

As shown best in FIG. 5, a distance $L_3$ is defined between the bottom or innermost surface of the groove 76 and the bottom or innermost surface of the groove 78, a smaller distance $L_4$ is defined between the lower lip 75 and the bottom surface of the groove 78, and a still smaller distance $L_5$ is defined between the upper lip 77 and the bottom surface of the groove 76. In accordance with one aspect of the invention, the distance $L_3$ is the same as the distance $L_1$ described above with reference to FIG. 3, the distance $L_4$ is somewhat larger than the distance $L_2$, and the distance $L_5$ is somewhat smaller than the distance $L_2$. Such dimensional control prevents disengagement of the hitch from the hook arrangement even if the jack 24 experiences some inadvertent retraction and a bucket experiences vibration. While in the embodiment shown, the hook arrangement 16 includes two hook members 70, it may be appreciated that it may consist of a single hook member which extends transversely to a considerable width, and thus the hook arrangement may include only a single lower hook portion 72 and a single upper hook portion 74.

In operation, and referring now to FIGS. 3 and 5, the hydraulic jack 24 is initially retracted by the vehicle operator so that the hitch 10 may assume the second condition shown in phantom in FIG. 3. Then, with suitable manipulation of lift arms 12 and the tilt links 14, and forward movement of the vehicle, the upper connecting member 40 is inserted from below into the grooves 78 in the upper hook portion 74 of the hook arrangement 16 to bring same to the condition shown in phantom in FIG. 5 and as identified by the letter A. In addition, due to tilting back of the lift links, the lower connecting member 26 of the hitch contacts the entry surfaces of the lip 75 so as to be positioned right above the groove 76, thus presenting a condition shown by the phantom line B. Then, the hydraulic jack 24 is extended so as to shift the hitch from its second condition to its first condition, whereby the lower connecting member is inserted downwardly into the groove 76 for fully seating engagement. Thus, the hitch is positively coupled to the hook, both to its upper side and at its lower side, thus bringing about the fully engaged position shown in FIG. 1. In such condition the lower link members 30 of the hitch are aligned with the upper link members 38 so that an external force, such as the weight of the bucket 18, will not be transmitted to the hydraulic jack. Thus, even in the event of fluid leakage from the jack, the hitch will not be disengaged from the hook. Furthermore, the impact reaction of the bucket with the ground due to lowering of the lift arms 12 will not be transmitted to the jack, but rather will be transmitted through the lower portion of the hitch and/or the upper connecting member to the lift arms, so that a jack of relatively small size may be used.

Disengagement of the hitch 10 from the hook arrangement 16 is accomplished by reversing the aforesaid procedure. Simply stated, the hydraulic jack 24 is first retracted to bring the hitch to the second condition shown in phantom in FIG. 3. With the bucket weight on the ground, raising of the lift arms 12 will bring the hitch and hook arrangement to the retracted condition shown by the phantom outline designated by the letter B in FIG. 5. This is accompanied by suitable manipulation of the tilt links 14 and rearward movement of the vehicle, whereupon the lower connecting member 26 is detached from the lower hook portion 72, and thereafter the upper connecting member 40 is detached from the upper hook portion 74. In this manner the hitch is quickly and conveniently disengaged from the hook arrangement on the bucket.

DESCRIPTION OF AN ALTERNATE EMBODIMENT

Figure 6:
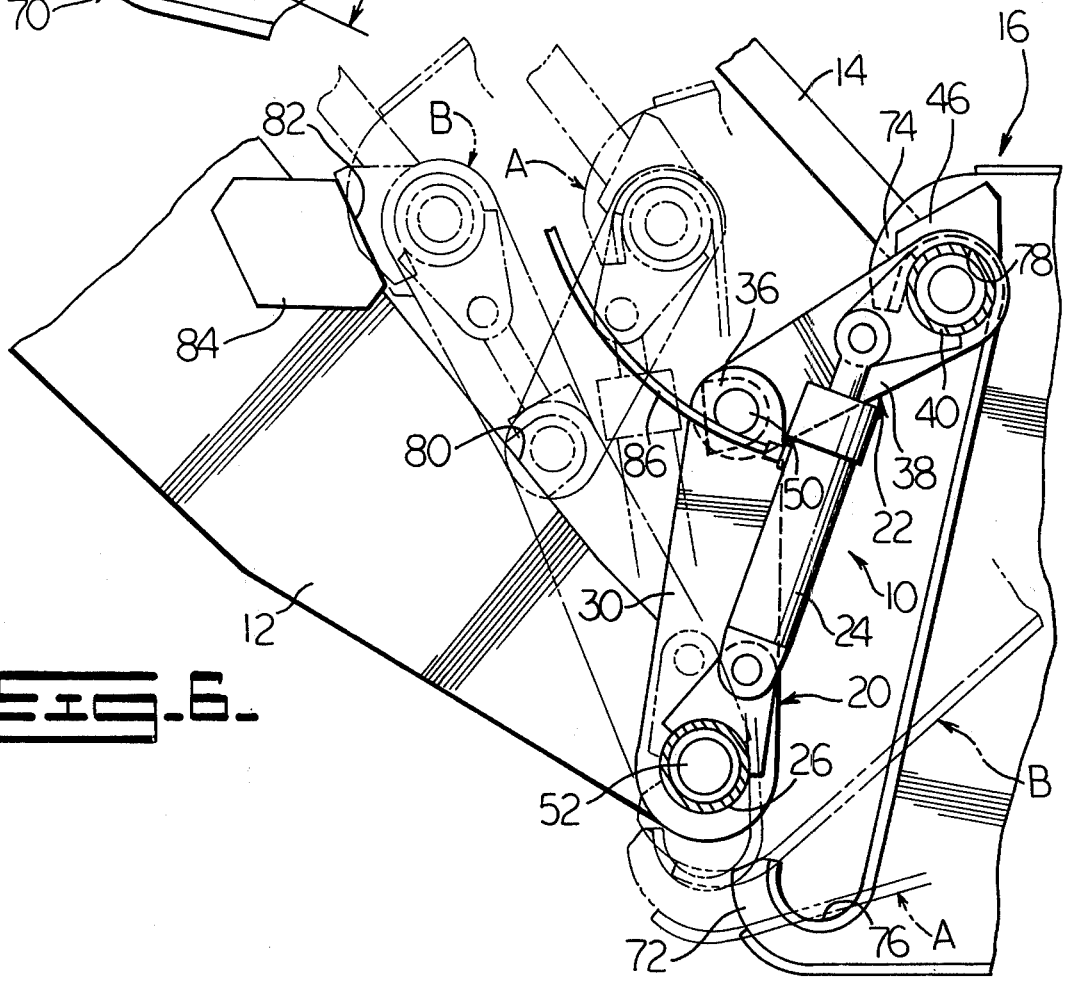
FIG. 6 is a cross sectional view diagrammatically illustrative of a coupling operation between the hitch and hook portions of an alternate embodiment quick coupler.

While the above described hydraulic jack 24 is of the double-acting type allowing both powered extension or retraction of the rod end thereof, the jack may be of a single-acting type which provides only powered retraction thereof as will now be described with reference to the alternate embodiment illustrated in FIG. 6.

In the alternate embodiment coupling of the hitch 10 to the hook arrangement 16 is initiated by powered retraction of the hydraulic jack 24 to the second or angularly collapsed condition. Then, due to a forward movement of the vehicle and suitable manipulation of lift arms 12 and the tilt links 14 the upper connecting member 40 is inserted from below and upwardly into the groove 78 in the upper hook portion 74, thus presenting the condition shown in solid lines in FIG. 6. When the tilt links are thereafter tilted back, the hitch is pivotally moved about the pins 52 to the phantom line position shown by the letter A. As a result, the hook arrangement is also rocked back to the same position. In such condition, the bearing portion 36 of each of the lower link members 30 is maintained in contact with an upper surface 80 on the lift arms 12, so that further rearward pivotal movement of the lower link members is prevented. When the tilt links are further tilted back, then the upper link members 38 are pivotally moved about the pins 50 to the phantom line position designated by the letter B, and with the hook arrangement following along therewith. In such a state, the bearing portions 46 of the upper link members 38 individually contact an upper surface 82 of a stop block 84 secured to their respective lift arms. Simultaneously, the hitch is brought into its first condition wherein the lower link members 30 are aligned with the upper link members 38 and the lower connecting member 26 is inserted into the grooves 76 of the hook. Upon forward movement of the tilt links, the hitch, the hook and the bucket are jointly rocked about the pins 52 in the clockwise direction when viewing the drawing, with the hitch maintaining the first or fully engaged position.

Accordingly, when a hydraulic jack of the single-acting type is used, it is necessary that positive contact be made between the upper surfaces 80 of the lift arms 12 and the bearing portions 36 of the lower link members 30, as well as positive contact between the upper surfaces 82 of the suitably positioned stop blocks 84 with the bearing portions 46 of the upper link members 38. Also, since the jack 24 is extended by the tilt links 14 when traveling between the A and B positions, a conventional relief valve, (not shown) should preferably be provided in communication with a supply line 86 leading to the jack so as to allow the return of fluid from the jack back to the reservoir.

Disengagement of the hitch 10 from the hook arrangement 16 is accomplished in the same manner as in the preferred embodiment. In other words, the hitch is brought into its second angularly collapsed condition due to the powered retraction of the hydraulic jack 24.

While the present invention has been described herein with reference to certain exemplary embodiments thereof, it should be understood that various changes, modifications and alterations may be effected without departing from the spirit and the scope of the present invention, as defined in the appended claims.

The embodiments of the invention in which an exclusive property or privilege is claimed are defined as follows:

1. A quick coupler for attaching and detaching an implement to a vehicle equipped with a lift arm and a tilt link, comprising:

a hook arrangement having a lower hook portion and an upper hook portion and being secured to the implement; and a hitch having a lower supporting assembly pivotally connected to the lift arm on a lower axis, an upper supporting assembly pivotally connected to the tilt link and pivotally connected to said lower supporting assembly on an upper axis, and an actuator pivotally connected between the supporting assemblies and being movable between an extended position and a retracted position, said lower and upper supporting assemblies being positioned between a substantially aligned first condition of reception in said lower and upper hook portions and an angularly collapsed second condition at said extended and retracted positions, said actuator having a central axis disposed forwardly of a plane passing through said lower and upper axes when said supporting assemblies are in said substantially aligned first condition.

2. The quick coupler of claim 1 wherein said lower supporting assembly includes a lower connecting member which extends horizontally and a pair of lower link members extending upwardly therefrom, and wherein said upper supporting assembly includes an upper connecting member which extends horizontally and a pair of upper link members extending downwardly therefrom, said lower and upper link members being pivotally connected together for movement between said first and second conditions.

3. The quick coupler of claim 2 wherein said lower and upper connecting members are cylindrical elements, said lower and upper hook portions being of a construction, for respectively receiving said lower and upper cylindrical elements.

4. The quick coupler of claim 3 wherein said lower hook portion has a lower lip and an upwardly opening groove, and said upper hook portion has an upper lip and a downwardly opening groove, and wherein a predetermined distance is defined between said lower lip and the bottom surface of said downwardly opening groove, a distance greater than said predetermined distance is defined between the bottom surfaces of both of said grooves, and a distance smaller than said predetermined distance is defined between said upper lip and said upwardly opening groove.

5. The quick coupler of claim 1 wherein said actuator is a single acting hydraulic jack.

6. The quick coupler of claim 5 wherein said single-acting jack is of a construction to be powerably retracted for obtaining said angularly collapsed second condition of the hitch for disconnect purposes from said hook arrangement.

7. A quick coupler for attaching and detaching an implement to a vehicle equipped with a lift arm and a tilt link, comprising:

a hook arrangement having a lower hook portion and an upper hook portion and being secured to the implement; and a hitch having a lower supporting assembly pivotally connected to the lift arm, an upper supporting assembly pivotally connected to the tilt link and pivotally connected to said lower supporting assembly, and single-acting jack means for retracting and moving said supporting assemblies from a substantially aligned first condition of reception in said lower and upper hook portions to an angularly collapsed second condition for disconnect purposes, said jack means including relief valve means for relieving pressure from said jack means due to a tilting back operation of said tilt link and extension of said jack means.

8. The quick coupler of claim 7 including stop means on said lift arm for effecting movement of the hitch between said second and said first conditions with a tilting back operation of said tilt link.

9. The quick coupler of claim 1 wherein said actuator is a double-acting hydraulic jack.

10. The quick coupler of claim 9 including pin means for pivotally connecting said upper and lower supporting assemblies together, and wherein said plane passes centrally through the axes of said lower and upper supporting assemblies and said pin means when the hitch is in said substantially aligned first condition.

* * * * *